US005718281A

United States Patent [19]

Bartalone et al.

[11] Patent Number: 5,718,281

[45] Date of Patent: Feb. 17, 1998

[54] COOLER RESERVOIR/FILTER HOLDER

[75] Inventors: Anthony G. Bartalone, Okemos; Maurie R. Petro, Kalamazoo, both of Mich.

[73] Assignee: Contech Division, SPX Corporation, Kalamazoo, Mich.

[21] Appl. No.: 377,159

[22] Filed: Jan. 24, 1995

Related U.S. Application Data

[63] Continuation-in-part of Ser. No. 242,191, May 13, 1994, abandoned.

[51] Int. Cl.[6] ..... F28F 19/01

[52] U.S. Cl. ..... 165/41; 165/119; 165/916; 210/86; 210/167; 210/171; 210/184; 210/130; 210/443; 210/223; 60/456; 60/912; 184/104.1; 220/577

[58] Field of Search ..... 210/184, 186, 210/171, 172, 167, 168, 774, 805, 443, 86, 130, 222, 223; 165/41, 44, 47, 119, 916; 60/912, 456; 184/104.1; 220/577, 562

[56] References Cited

U.S. PATENT DOCUMENTS

| | | | |
|---|---|---|---|
| 1,607,610 | 11/1926 | Eckstein et al. . | |
| 2,405,135 | 8/1946 | Butzbach | 60/912 |
| 2,468,866 | 5/1949 | Collier | 210/186 |
| 2,834,469 | 5/1958 | Mitterer | 165/119 |
| 3,478,648 | 11/1969 | D'Alba | 60/192 |
| 3,752,222 | 8/1973 | Olbermann, Jr. . | |
| 3,786,920 | 1/1974 | Raymond | 210/172 |
| 4,022,272 | 5/1977 | Miller . | |
| 4,033,872 | 7/1977 | Mori | 210/168 |
| 4,082,665 | 4/1978 | Schneider et al. | 210/91 |
| 4,207,187 | 6/1980 | Booth | 210/130 |
| 4,517,083 | 5/1985 | Hayes et al. | 210/131 |
| 4,531,574 | 7/1985 | Hoch . | |
| 4,650,572 | 3/1987 | Hayes | 210/131 |
| 4,813,477 | 3/1989 | Hansen et al. | 165/32 |
| 5,002,117 | 3/1991 | Buckley et al. | 60/456 |
| 5,036,911 | 8/1991 | So et al. . | |
| 5,095,971 | 3/1992 | Hehl . | |

FOREIGN PATENT DOCUMENTS

| | | |
|---|---|---|
| 615595 | 1/1949 | United Kingdom . |

*Primary Examiner*—Robert J. Popovics
*Attorney, Agent, or Firm*—Barnes, Kisselle, Raisch, Choate, Whittemore & Hulbert

[57] ABSTRACT

A power steering pump fluid/filter system which utilizes a combined cooler, filter and reservoir that is positioned preferably in front of the radiator and which provides the three functions of reservoir, cooler and filter. The reservoir comprises a body of material such as magnesium or aluminum and has integral cooling fins. The body includes two openings in the base which permits ready connection to the two hoses of the power steering pump. The combined cooler, filter and reservoir also includes a cover typically made of magnesium or aluminum and a cap having a twist lug connection to the cover. The cap supports a dipstick for measuring the level of the oil.

23 Claims, 8 Drawing Sheets

COOLER RESERVOIR/FILTER HOLDER

This application is a continuation-in-part of our application Ser. No. 08/242,191, filed May 13, 1994.

This invention relates to vehicle power steering pump systems.

BACKGROUND, OBJECTS AND SUMMARY OF THE INVENTION

In vehicles, it is common to position the power steering pump and fluid reservoir in a position rearwardly of the front end of the vehicle within the engine compartment. In such an arrangement, the power steering reservoir is often in a location of low air movement. Typically, the limited heat transfer through the walls of hoses and the plastic reservoir associated with the pump is inadequate to cool the fluid properly. It has been suggested that a separate cooler as well as a separate filter be added to the power steering system fluid actuating circuit in series flow with the reservoir, but this is costly and would add weight to the vehicle.

Among the objectives of the present invention are to provide a power steering pump fluid/filter system that utilizes a combined cooler, filter and reservoir which is constructed and arranged to provide maximum cooling; which is positioned to be more directly installed in the air stream in front of a radiator; which is less costly and adds less weight as contrasted to systems that would use separate coolers and filters.

In accordance with the invention, the system utilizes a combined cooler, filter and reservoir that is positioned preferably in front of the radiator and which provides the three functions of reservoir, cooler and filter. More specifically, the reservoir comprises a body of material such as magnesium or aluminum and has integral cooling fins. The body includes two openings in the base which permits ready connection to the two hoses of the Dower steering pump. The combined cooler, filter and reservoir also includes a cover typically made of magnesium or aluminum and a cap having a twist lug connection to the cover. The cap supports a dipstick for measuring the level of the oil.

BRIEF DESCRIPTION OF THE DRAWINGS

Other objects, features and advantages of the invention will become apparent from the following detailed description, appended claims and accompanying drawings forming part of the specification (which are to scale unless otherwise indicated), wherein:

DETAILED DESCRIPTION OF THE PREFERRED EMBODIMENTS

Figure 1:
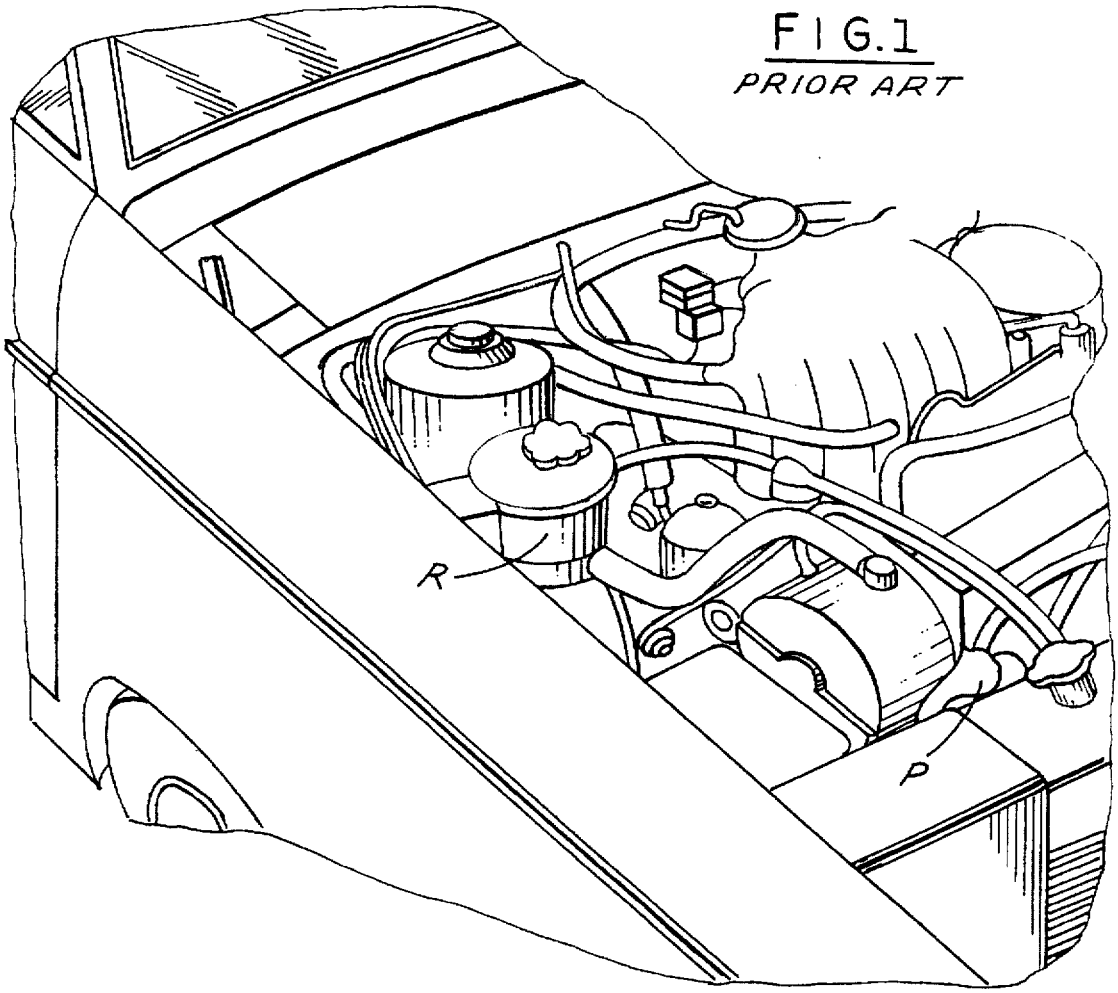
FIG.1 PRIOR ART
FIG. 1 is a fragmentary perspective vertical view "under the hood" of an automobile engine compartment containing a prior art power steering system.

Referring to FIG. 1, a conventional power steering system for automobiles normally positions the reservoir R which is made of plastic rearwardly of the front end of the engine while the power steering pump P is usually located at the front of the engine.

Figure 2:
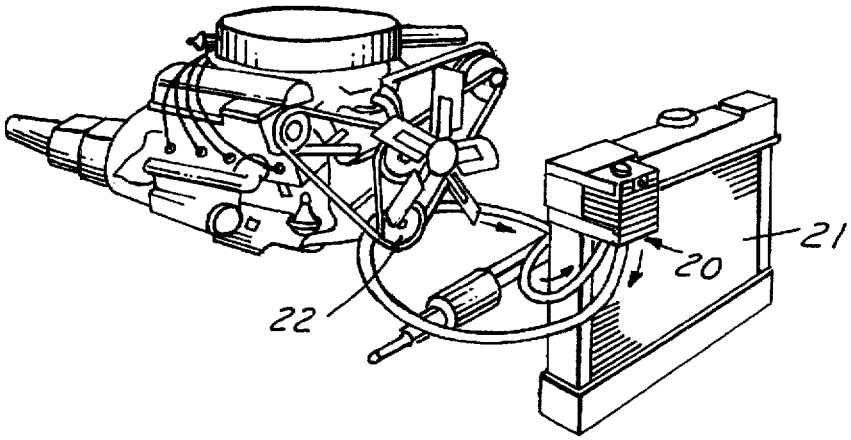
FIG. 2 is a partly diagrammatic perspective drawing of a power steering pump system embodying the invention.

In accordance with one embodiment of the system of the invention, as shown in FIG. 2, a combined cooler, reservoir and filter holder unit 20 is mounted forwardly of the radiator 21 so that it is in the direct oath of air flow, and is connected to inlet and outlet hoses which extend therefrom respectively to the outlet of the control valve of the usual rack and pinion power steering unit PSU and to the hydraulic power steering pump 22 which is at a lower level than unit 20.

Figure 5:
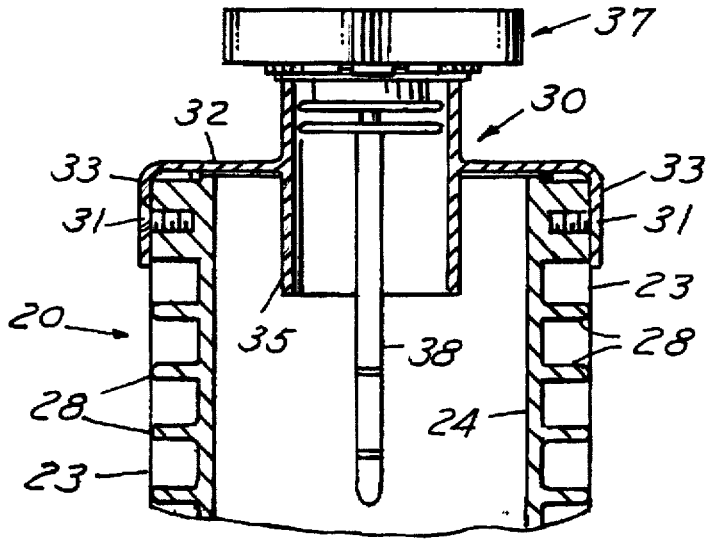
FIG. 5 is a fragmentary vertical sectional view taken on the line 5—5 of FIG. 3.
Figure 4:
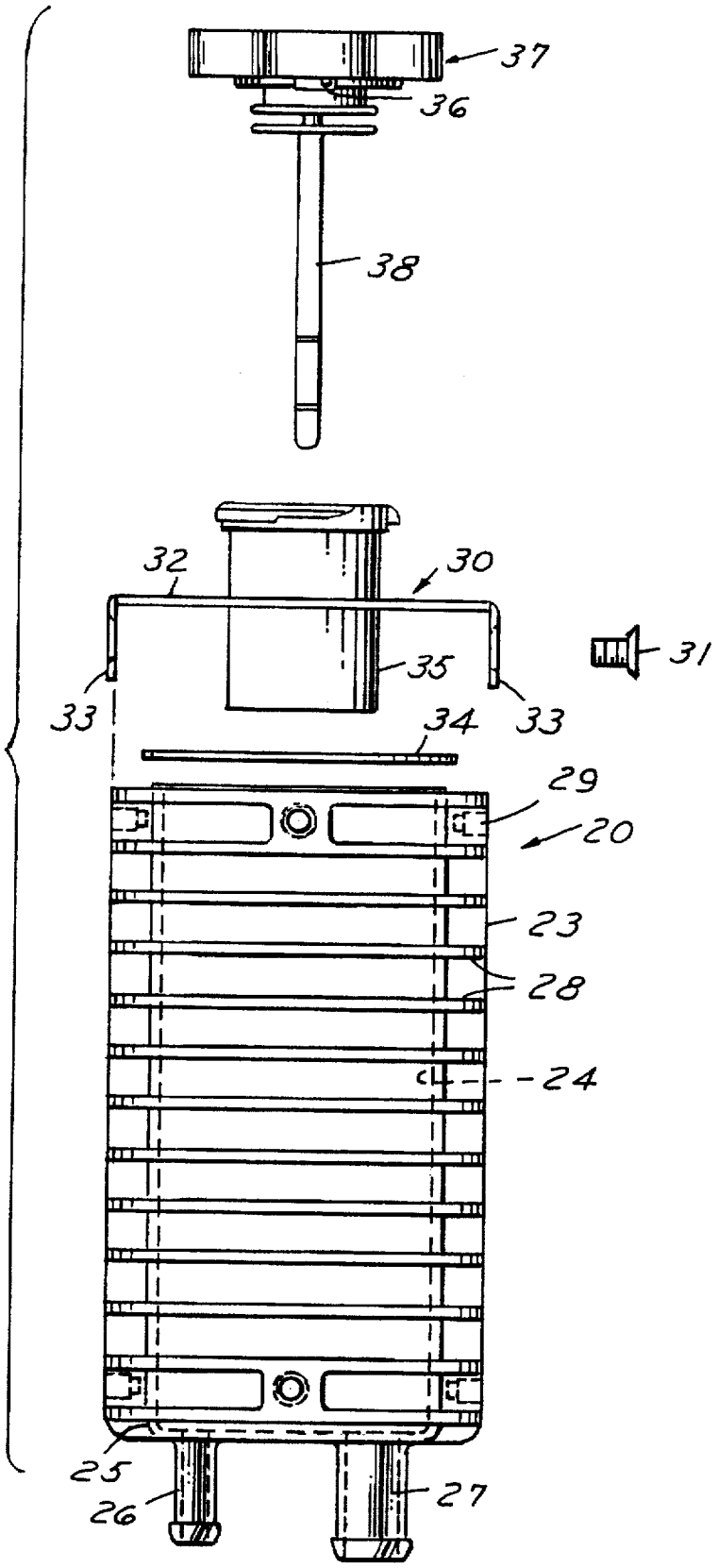
FIG. 4 is an exploded elevational view of the combined cooler, reservoir and filter unit of FIG. 3.

As shown in the drawings, the combined cooler, reservoir and filter holder unit 20 comprises a main body 23 which has a cylindrical side wall 24 and a base wall 25 with integral pipes 26, 27 for connection respectively to the outlet and inlet of the pump P. The body 23 further includes a plurality of vertically spaced integral cooling fins 28 that extend exteriorly beyond the wall 24 of the body 23. As shown in broken lines in FIG. 4 and solid lines in FIG. 5, the wall 24 of the body is very thin as are the fins 28.

A cover 30 is provided at the to or upper end of the body 23. One arrangement which can be used is herein described wherein the upper end of the body includes a flange 29 onto which a cover 30 is fixed by screws 31. The cover 30 has a transverse wall 32 and vertical tabs 33 through which the screws 31 extend. A seal 34 is provided between the underside of cover 30 and wall 24. The cover 30 further includes an open ended cylinder 35 integral with the cover 30. Cover 30 has a notched end flange 35*a* (FIG. 4) for engagement with radial lugs 36 on a cap 37 in accordance with conventional practice for liquid systems in vehicles. A dipstick 38 extends downwardly from the underside of the cap for measuring the level of fluid in the reservoir formed by the body 23.

The body 23 and cover 30 are preferably die cast of lightweight heat conductive metallic material such as a magnesium or aluminum alloy, as contrasted to plastic.

A filter is provided in the body and associated with the inlet and outlet. Any type of filtering using both magnetic and pore space screening is preferred. The filter thus includes a magnet used to capture metallics in the fluid. The design and arrangement is such as to flow the fluid, by baffling, over the magnet so as to maximize the magnet collective ability. The filter includes a filter media, typically of paper or felt. The area of the filter is custom designed for the customer-specified volume of flow and pressure, as are the microns pore spacings for screening. In most cases, the pore spacings will be 10–60 microns. Trials have shown that a 25 micron filter, combined with a properly designed magnet arrangement, will remove 99% of the particles, whereas 60 micron filter will remove 80% of the particles.

A spring-loaded filter by-pass relief valve is provided to prevent damage to the filter by high viscosity power steering fluid conditions during cold starts. A body is provided to contain the filter, magnet, and by-pass valve. The body may be solid or mesh, made of metal or plastic material.

Figure 6:
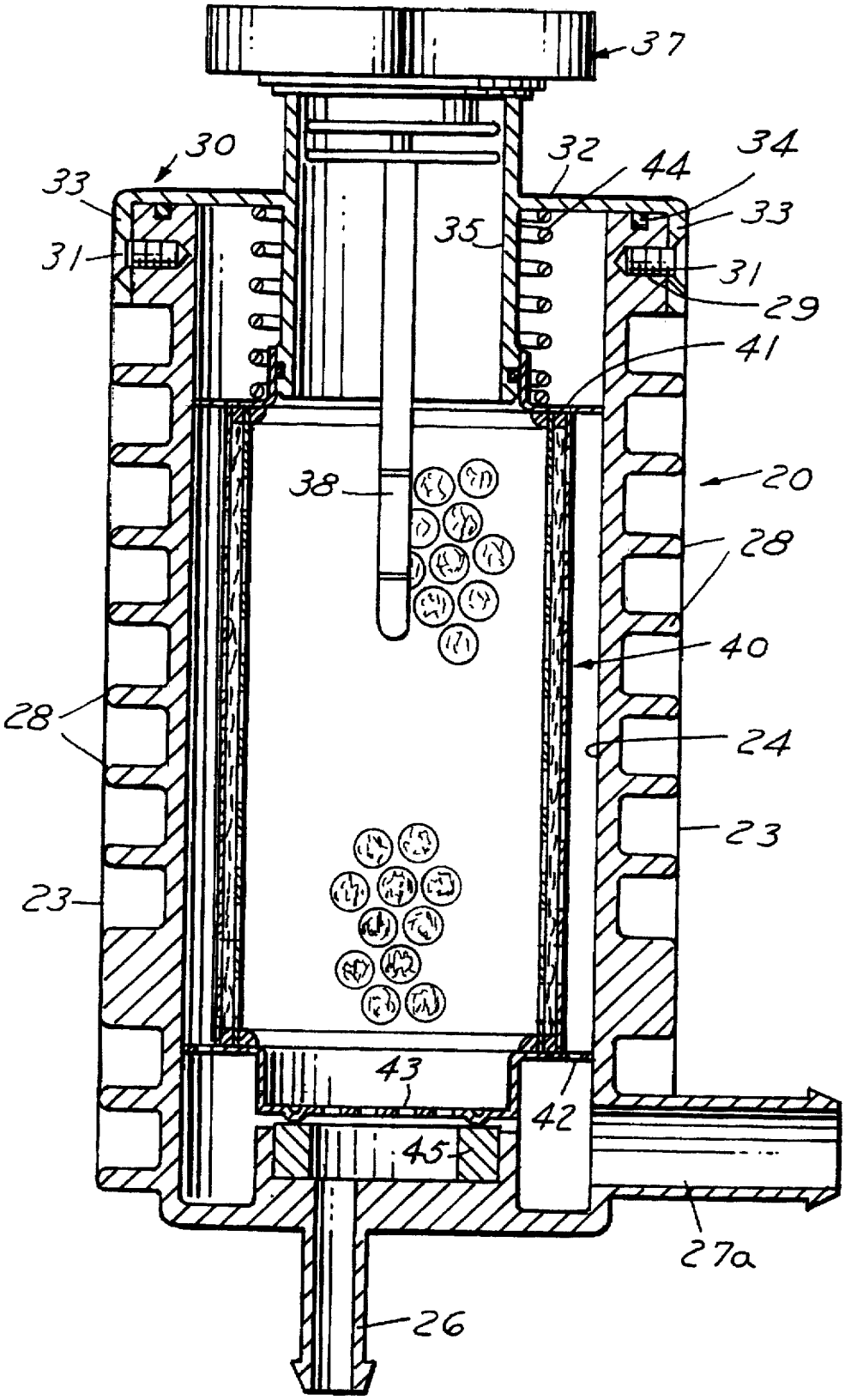
FIG. 6 is a sectional elevational view similar to FIG. 5 showing a filter in installed position and a modified outlet pipe.

As shown in FIG. 6, one type of filter comprises a cartridge 40 which includes a body having an upper end 41 and lower end 42 closing about a tubular screen containing a filter media. The lower end includes a wall 43 having openings. A spring 44 urges the filter downwardly onto a magnet 45 supported by a shoulder to provide a by-pass valve function. Flow of fluid is upwardly through inlet 26 through the wall 43 into the filter and outwardly through the filter media to the outlet 27*a*, herein shown as extending laterally. Alternatively, the filter can be of the type wherein fluid flows radially inwardly into the filter, as shown in U.S. Pat. No. 4,689,144, incorporated herein by reference.

From the foregoing description and accompanying drawing figures referenced therein, it also will now be apparent that the invention is well adapted to satisfy both O.E.M. and after market automotive needs for improved cooling, filtering and reserve storage of power steering fluid in vehicles. In many such conventional vehicle power steering applications in use today the power steering pump P runs continuously to provide a pressurized output of power steering fluid, typically at a pressure of 30 PSI maximum and at a flow rate of 3 to 4 gallons per minute maximum. The conventional control and by-pass valve associated with the rack and pinion power steering unit PSU (FIG. 2) directs the power steering fluid flow under pressure from this unit back to the filter and reservoir, and fluid is then fed from the reservoir by gravity and/or suction flow to the pump inlet. It will be seen that the combined cooler, filter and reservoir unit of FIGS. 1 through 6 provides one embodiment of the invention which is highly compatible with this type of conventional power steering system. In addition, unit 20 embodies several features which satisfy major considerations involved in meeting automotive system requirements, i.e., manufacturability, material availability, component reliability and production costs while also successfully addressing the need for compatibility with power steering applications operating on continuous fixed displacement flow, with pressure in and gravity out.

The primary component of unit 20, namely the main body 23 with the thin cylindrical side wall 24, is constructed as a one-piece casting having the thin cooling fins 28 protruding outwardly from and made integrally with reservoir body 23 in a casting process. The fins and reservoir body are thus made of one and the same highly heat conductive material, i.e., aluminum or magnesium material, thereby rendering the reservoir body and the fins monolithic by fusion together from the casting melt (i.e., integral) and hence highly efficient in transferring heat from the power steering fluid contacting the interior surface of wall 24, by conduction through body wall 23 directly by radiation and by forced and convection air flow to ambient, as well as by and through the fins 28 and thence to ambient. By contrast, in prior art welded cooling fin attachment constructions, not being monolithic, the weld joint inhibit conductive heat transfer from a reservoir body or tubular fluid conduit to such separately attached cooling fins.

Unit 20 is also well adapted to satisfy automotive customer requirements for ready access to and ease of filling the reservoir, namely to have a large well-labeled removable cap 37 with associated dipstick 38 which must be easily seen and readily accessible when the hood is raised for checking and replenishing of this and various other reservoirs of the automotive fluid systems, i.e., engine coolant in radiator 21, engine oil, windshield washer fluid reservoir, battery, etc. Ease of removal and replacement of the filter cartridge 40 in unit 20 is also an important consideration satisfied by the invention. Additionally, with unit 20 pressurized fluid flow into the unit, and gravity or suction flow out of the unit, both occur at or in the vicinity of the bottom of body 23 to insure both full utilization of reservoir capacity as well as maximum utilization of the heat transfer cooling capabilities of the unit.

Figure 7:
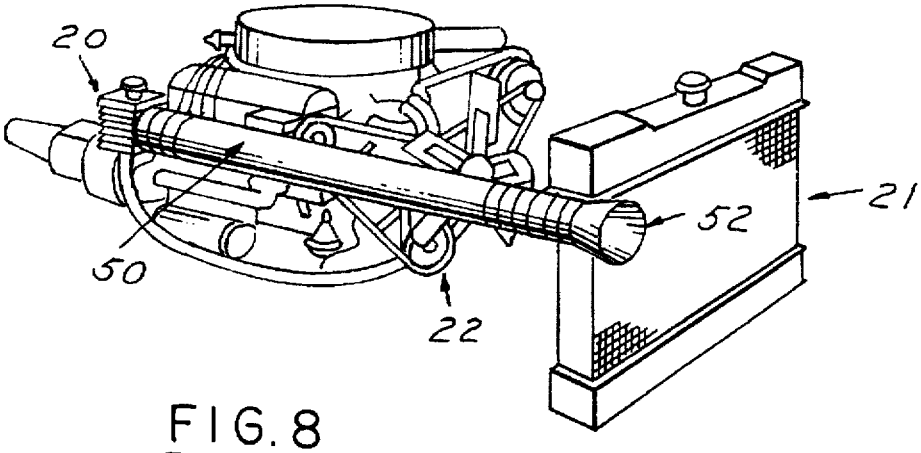
FIGS. 7 and 8 are partly diagrammatic perspective drawings similar to FIG. 2, of second and third embodiments respectively of power steering Dump systems embodying the invention.

The invention in its various forms is also readily adaptable to differing customer requirements and diverse engine compartment layouts. Thus, although positioning of the unit 20 forwardly on the front of the radiator as illustrated in the system installation of the invention shown in FIG. 2 is the preferred location for direct exposure to high volume cooling air flow induced by the radiator cooling fan and/or vehicle forward motion, this may not be possible in all customer applications due, for example to hood line restraints. Accordingly, as set forth by way of further example in the system modification as shown in FIG. 7, unit 20 may be mounted on a suitable bracket at the rear of the engine, and then a suitable conduit 50 provided to direct the vehicle movement and/or the radiator fan air stream from the area laterally adjacent and/or upstream of radiator 21 to unit 20. Conduit 50 can be provided with an outwardly flaring frustoconical inlet 52 to create a vortex in the air stream in conduit 50 and thus provide a high velocity cooling air stream to unit 20 to thereby compensate for its otherwise adverse cooling location rearwardly of the engine.

Typically, conduit 50 may be constructed of conventional flexible hose made of lightweight plastic material with interior helically wound flexible wire support, as customarily provided in automotive air conditioning and heater conduit hoses. Such flexible air supply hose material is readily adaptable for bending and routing to thereby alter the location of inlet 52, as indicated by the modified arrangement shown in FIG. 8 wherein a modified conduit 54, provided with the reverse megaphone inlet 52, is rearranged to locate inlet 52 at a location laterally adjacent near the bottom and upstream of radiator 21, should this be the optimum air input location in a given vehicle application.

Figure 8:
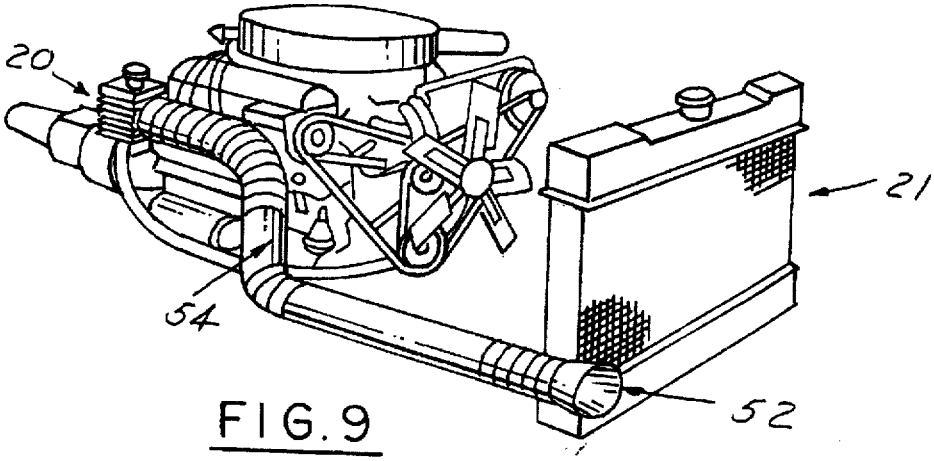
Figure 9:
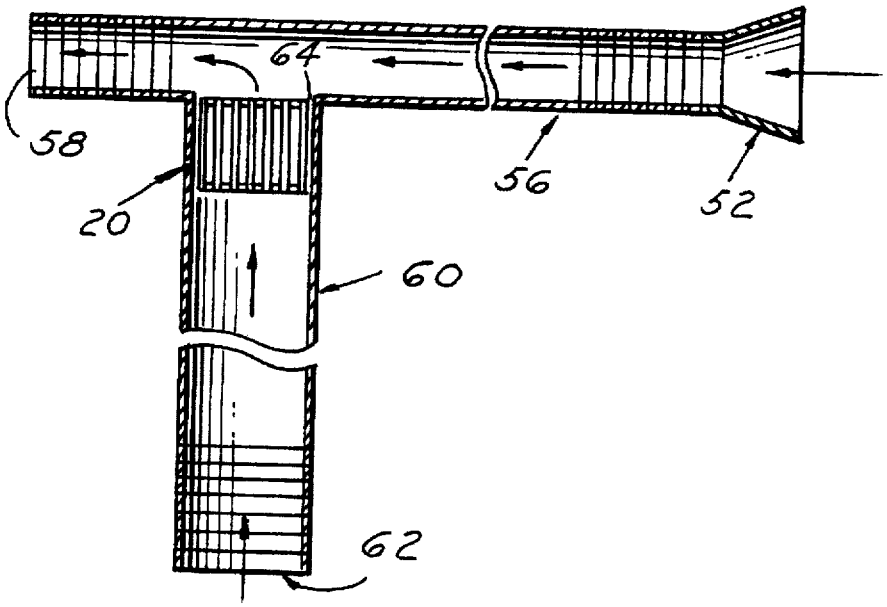
FIG. 9 is a partly diagrammatic fragmentary vertical center sectional view of a fourth embodiment of a power steering pump system embodying the invention.

Similarly, as illustrated diagrammatically in FIG. 9, unit 20 may be located at an appropriate location rearwardly of radiator 21 in a "T" air conduit system. In the FIG. 9 arrangement, a flexible hose air conduit 56, again having the flared inlet 52, may be positioned similar to conduit 50 in FIG. 7 or conduit 54 in FIG. 8. However, the exit end 58 of conduit 56 is left wide open to discharge air flow freely therefrom. A branch air duct 60 is then oriented vertically with an open inlet 62 at its bottom end, and is joined to tube 56 at its upper end so that its outlet 64 communicates flush with the wall of tube 56. As shown schematically in FIG. 9, unit 20 suitably mounted and disposed in branch pipe 60 adjacent its upper end out of the direct air flow axially through conduit 56. In this manner, ram air flow from fan or vehicle movement passing axially through conduit 56 flows over the top of unit 20, thereby causing siphon pump action to draw air upwardly through branch pipe 60 from inlet 62 so as to flow over the cooling fins of unit 20 and thence into the air stream in conduit 56 for exit via outlet 58.

Figure 3:
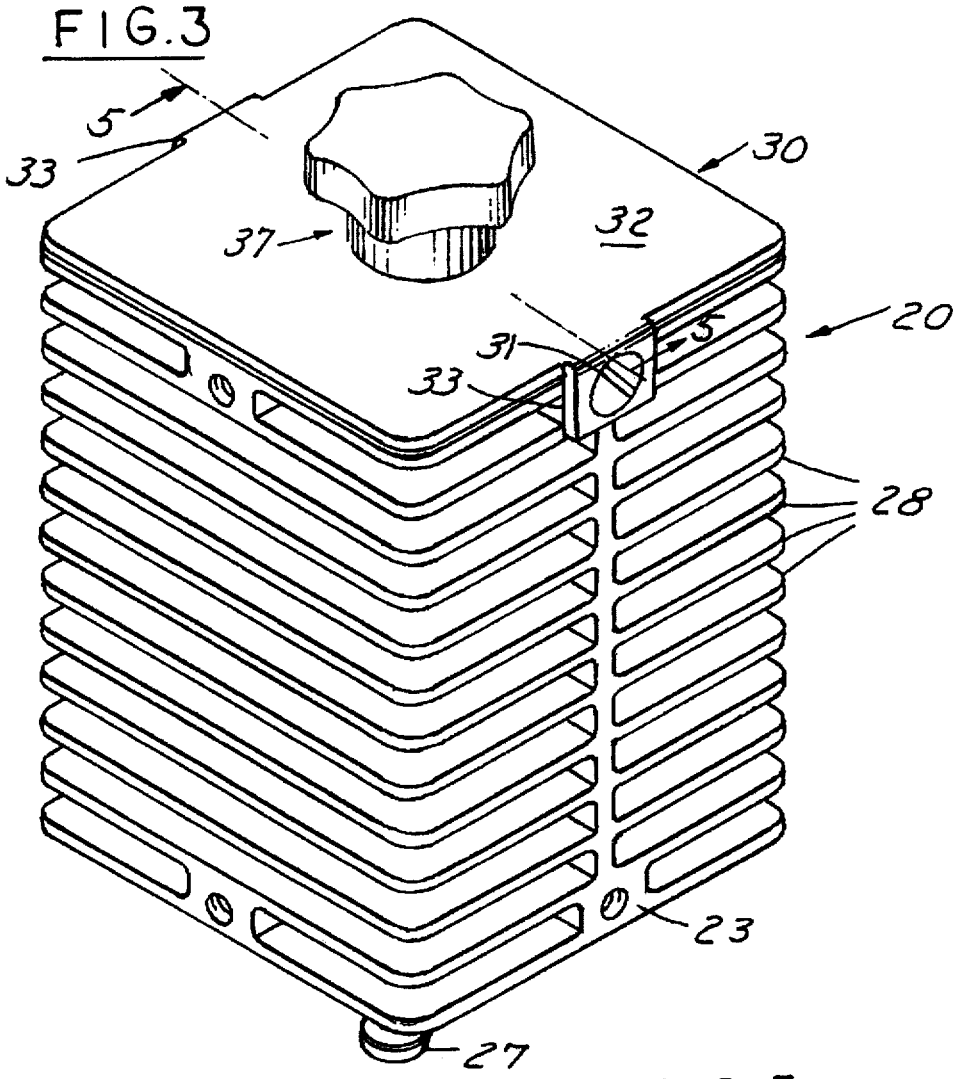
FIG. 3 is a perspective view of one embodiment of the combined cooler, reservoir and filter unit of the invention.

The system of FIG. 9, with its two diverse inlets 52 and 62 thus can take advantage of differing air flow and temperature conditions extant in a given vehicle application to optimize power steering fluid cooling requirements for the same. Under vehicle idling or vehicle engine shut down conditions, convection air flow from below the vehicle upwardly through conduit 60 and out conduit 56 is available to augment the cooling of unit 20. Of course, the T-tube arrangement shown only schematically in FIG. 9 may be readily provided with a suitable mounting compartment and/or removable cover built into conduit 56 to provide access to cap 37 of unit 20 from above. Also, the exterior integral cooling fins of unit 20 may be reoriented to run vertically of the unit parallel to air flow through as well as past the fins. Likewise, if desired, the exterior configuration of the fin periphery may be made cylindrical rather than square or rectangular as shown in FIG. 3, to conform to the typical cylindrical cross-sectional geometry of air hoses.

The combined cooler, filter and reservoir unit of the invention may itself be further modified in accordance with the invention as illustrated by way of preferred example in a second embodiment unit 100 shown in FIGS. 10–14. Unit 100 is shown in assembly in FIG. 10 and, like unit 20, is well adapted for use in power steering systems operating with continuous fluid flow from pump P, with pressure fluid input to the unit and gravity flow or suction flow out of the unit. Unit 100 also incorporates a magnetic metallic fines separator 102, a cylindrical-type disposable mechanical filter element 104 to remove non-metallic particles; a cold start spring loaded by-pass valve 106 and associated valve spring 107 for preventing high viscosity power steering fluid from damaging the filter; an air cooled monolithic thin finned and thin-walled housing 108 closed at its lower end and openable at its upper end for vertical orientation of the housing in use; and a combination cover and fill tube/cap retainer 110 for removably receiving a quarter-turn-type fill cap 112 thereon with dependently attached dipstick 114. Unit 100 further incorporates several additional improvement features over unit 20.

The interior cooling and filtering components of unit 100 encased within reservoir housing 108 comprise a multipiece subassembly which may be installed or removed either seriatum or as an entire subassembly when cover 110 is removed from housing 108. This subassembly includes a cup-like filter case 116 containing filter cartridge 104, a case cap 118 removably inserted on and into the open upper end of case 116, a coolant recirculation shroud 120 removably abutted at its lower end on, or integrally incorporating, cover 118, and a fill strainer shroud/screen part 122 removably inserted into the open upper end of shroud 120.

Filter case 116 may be injection molded of any suitable lightweight plastic material and has a slightly tapering, upwardly divergent side wall 130 merging integrally at its lower end with a bottom end wall 132 having an annular lip 134 defining a circular opening in the bottom wall. Lip 134 fits sealably in a groove of an annular elastomeric seal 136 which in turn slips sealably onto and encircles an upwardly protruding hollow inlet boss 138 cast integrally with bottom wall 140 of housing 108. The upper end of case 104 has an annular outwardly stepped portion 142 to define an internal shoulder seat for an 0-ring 144. A further outwardly stepped portion 146 defines the upper rim of case 104 and provides a seating shoulder for a cap flange 148 protruding radially outwardly from an annular cylindrical skirt portion 150 of cap 146. Cap 146 has a top wall 152 with a circular outer edge which seats abuttingly on case rim portion 146. Well 152 defines with flange 148 a groove for receiving an annular seal 154. Cap 118 also has an upwardly protruding central boss 156 having a central retainer dimple 158 and a flow divider vane 160 protruding radially outwardly and overlapping the subjacent portion of top wall 152.

The lower interior end of case 116 has an annular row of spaced apart ribs 162 on which magnet 102 seats, magnet 102 being in the form of a ring of rectangular cross section for flow of incoming fluid through the center thereof. The fluid is then radially diffused by the radiating spokes of a separating magnet ring 102 from the lower end of filter cartridge 104. Fluid also flows outwardly around magnet 102 in the spaces between ribs 162, ribs 162 thus serving as a flow diffuser relative to magnet 102.

The filter is preferably of the type shown in U.S. Pat. No. 4,689,144 incorporated herein by reference.

Figure 13:
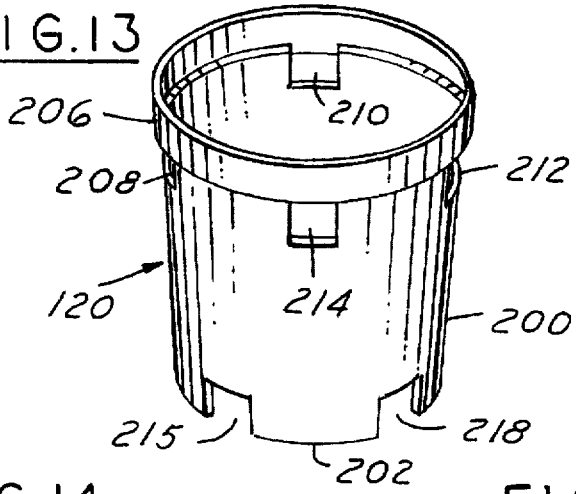
FIGS. 13 and 14 are respectively perspective and vertical center sectional views of a recirculation shroud shown by itself and also illustrated in the assembly view of the unit in FIG. 10.
Figure 14:
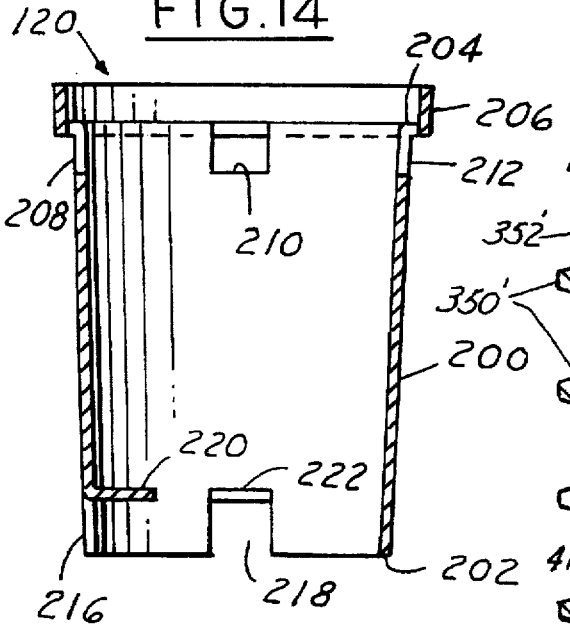

The function of a recirculation shroud is to direct the fluid from the filter exit to the top of the cooler, thereby maximizing the unit cooling efficiency. Recirculation shroud 120, which is one reiteration of the configuration also may be constructed of lightweight plastic material by injection molding and has a slightly tapered frustoconical side wall 200 terminating at its lower end in a circular edge 202 which abuttingly seats on the upper surface of top wall 152 of cap 118. As best seen in FIGS. 13 and 14, shroud 200 has an annular outwardly protruding shoulder portion 204 near its upper end merging integrally with a cylindrical rim flange 206 defining the upper end of wall 200. Four equally angularly spaced openings 208,210,212 and 214 are provided in wall 200 immediately below shoulder 204. A similar row of notched openings 16, 218 are provided in the lower end of wall 200 as interruptions in edge 202. Each of the lower edge openings 216,218 has an associated radially inwardly facing tab 220, 222 associated therewith and integrally joined to its radially outer edge to side wall 200.

The shroud configuration functions to recirculate and direct fluid to the top of the unit. The specific configurations will vary with different applications and filters.

Shroud/strainer part 122 comprises a plastic injection molded lightweight cup-like upper carrier part 300 having a generally frustoconical, slightly upwardly and outwardly divergent side wall 302 integrally terminating at its upper edge at a radially outwardly extending annular shoulder flange 304. Flange 304 in turn merges at its outer edge with a generally cylindrical rim flange 306 at the upper end of cup 300. Side wall 302 is provided with a plurality of the angularly spaced, axially extending and radially outwardly protruding ribs 308 which extend between flange 304 and in-turned bottom wall flange 310 at the lower end of cup 300. A cup-shaped filter screen 312 is inserted downwardly through the open bottom end of cup 300 and is carried at its upper out-turned edge 314 by flange 310. The cup/screen Dart 122 is adapted to be inserted downwardly into shroud 120 to the assembled position shown in FIG. 10, wherein the upper edges of cup rim 306 and shroud rim 206 are flush and covered by a flat gasket ring 320 which also sealably seats on the upper surface of an annular integral mounting flange portion 322 at the upper end of housing 108.

Figure 12:
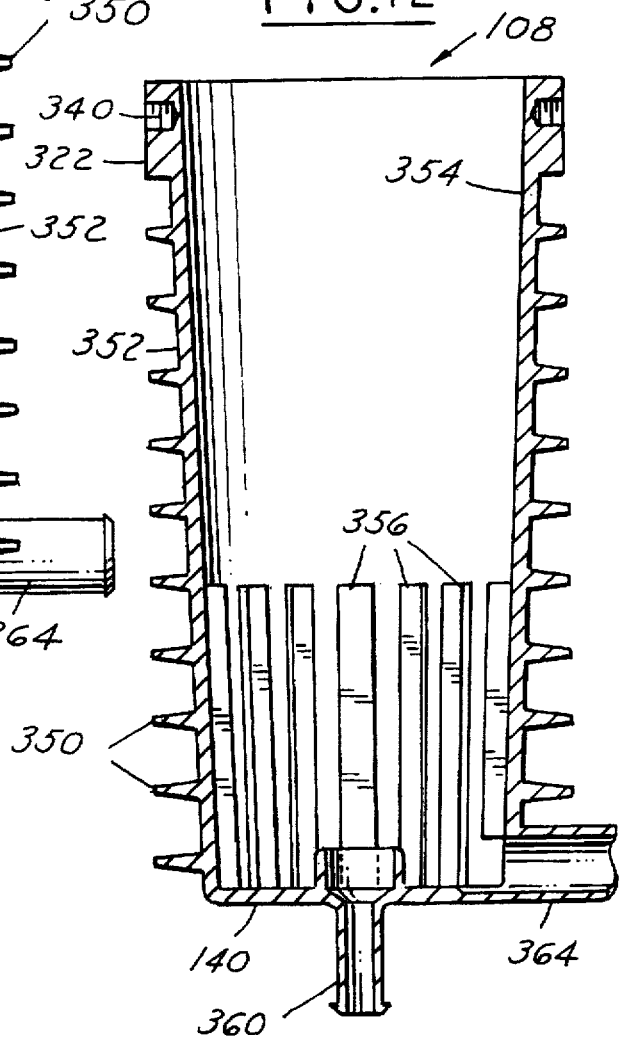
FIG. 12 is a vertical center sectional view of the main body of the unit of FIGS. 10 and 11 shown by itself.

Housing cover 110 is a one-piece cast part, made of the same monolithic material as housing 108, and has a flat top wall 330 with cooling fins 332 protruding integrally upwardly therefrom. The outer edge of wall 300 has a cylindrical skirt 334 dependent therefrom which slips over housing flange 322 and is secured thereto by mounting screws 336, 338 received in associated threaded openings 340 (FIG. 12). As so mounted, cap 110 clamps gasket 320 in sealed relation between the under surface of the cap and upper surface of housing flange 322. Cap 110 holds cup/screen part 122 in place in shroud 120 and, through gasket 320, holds shroud 120 seated on filter casing 116, and seal 136 sealably engaged on housing bottom wall 140. Cap 110 also includes a cylindrical, open ended fill spout cylinder 340 cast integrally with wall 330 of the cap and functioning in the manner of fill spout 35 of unit 20 described previously for receiving a quarter-turn-type removable fill cap 112 on the upper end of the same.

Reservoir housing 108 also includes a vertically spaced series of thin annular cooling fins 350 cast integrally with the slightly frustoconical thin side wall 352 of housing 108 and protruding radially outwardly therefrom. It is to be noted that ribs 350 have a tapered cross section largest at their integral as-cast junction with wall 352 to thereby maximize the cooling efficiency of the fins. The housing interior wall surface 354 either full length or a portion thereof, is provided with angularly spaced-apart row of inwardly protruding and vertically extending ribs 356 (FIG. 12) which terminate at free edges in relatively closely spaced relation to the exterior surface of wall 130 of filter case 116. Ribs 356, like ribs fins 350, have a tapered cross section largest at their integral as-cast junctions with side wall 352 to again promote efficient heat transfer.

Figure 10:
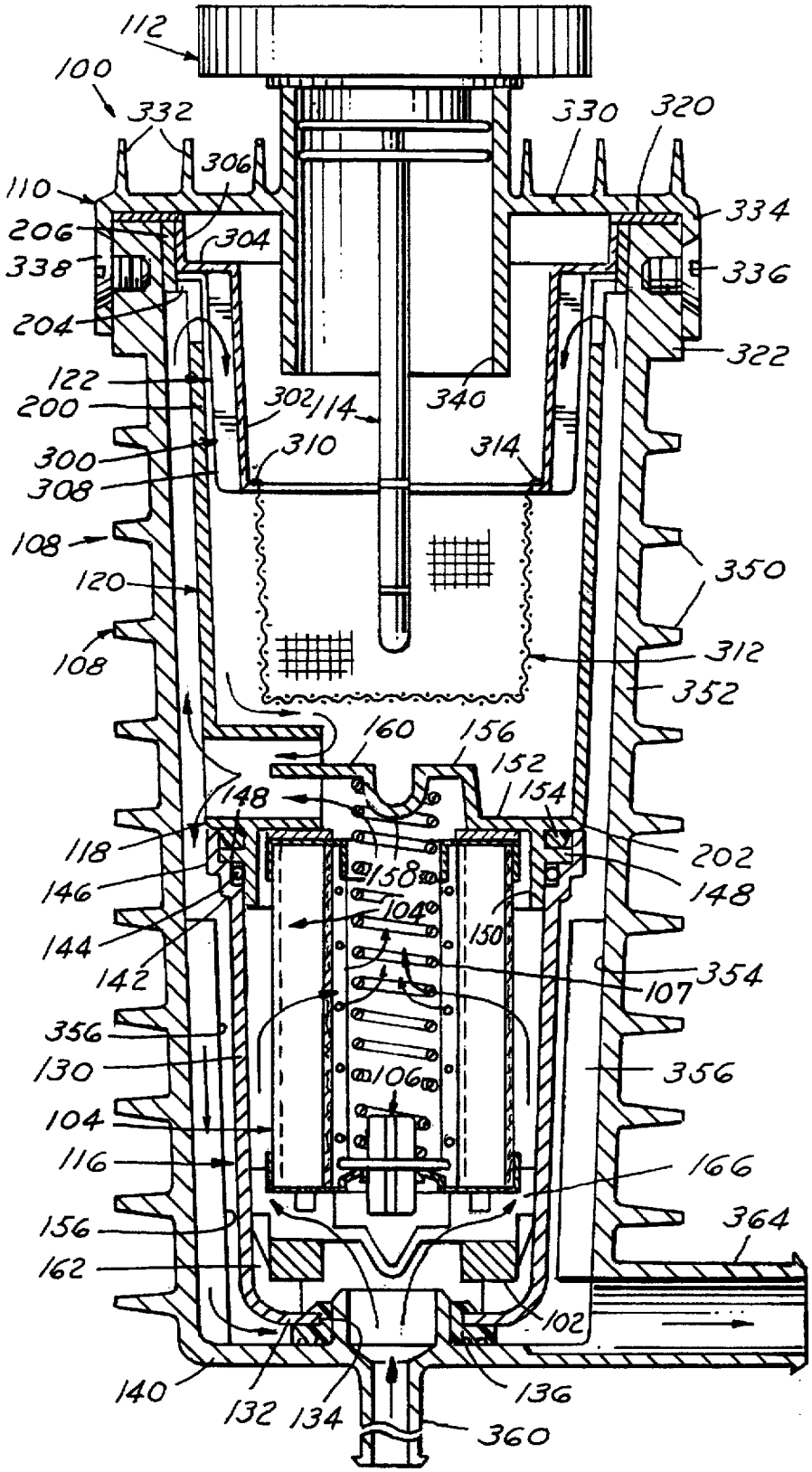
FIG. 10 is a vertical center sectional view of a second embodiment of the combined cooler, reservoir and filter unit of the invention.
Figure 11:
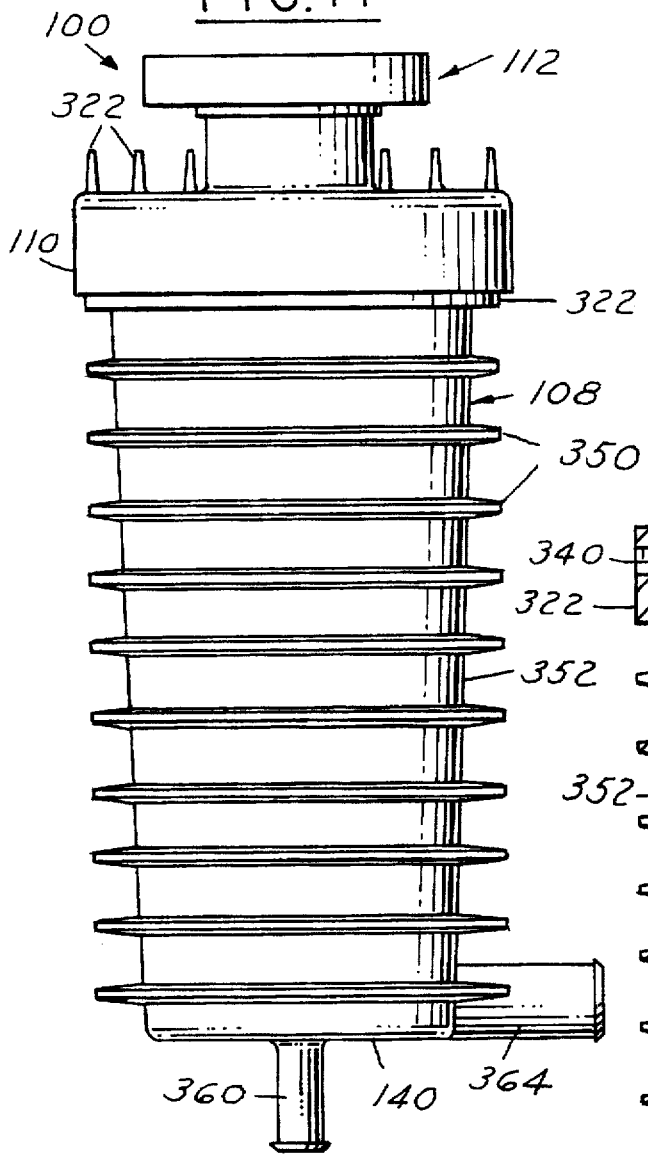
FIG. 11 is a vertical elevational view of the unit of FIG. 10.

Bottom wall 140 of housing 108 has an integral nipple inlet pipe 360 protruding coaxially dependent therefrom which removable receives one end of the system hose 362 for delivering pressurized power steering fluid from the valve unit of the power steering unit PSU (FIG. 2) into housing 108. The gravity or suction flow fluid outlet of housing 108 also comprises a nipple-type outlet pipe 364 cast integrally at its inner end with the bottom and side walls 140 and 352 of housing 108. The inlet end of pipe 364 communicates with the annular reservoir outlet flow space around and beneath the lower end of filter case 116 (FIG 10). Nipple 364 removable receives one end of the Dower steering fluid hose 366 which connects unit 100 in gravity or suction flow relation to the power steering pump 22 (FIG. 2), unit 100 being positioned at an elevation above that of pump 22 to promote such gravity flow.

From the foregoing it will now be apparent that the modified unit 100 provides a combination magnetic metallic fine separator, mechanical filter to remove non-metallic particles, cold start by pass valve protection, an internal fluid recirculation shroud, a system reservoir for storing an adequate reserve supply of power steering fluid, an air cooled monolithic externally and internally thin-finned and thin-walled housing, and a combination cap/cover/retainer providing a fill strainer and fluid level dipstick all in one compact and economically manufacturable unit. The internal parts are easily removable as a complete subassembly or seriatum from their stacked-up array for service and replacement. The internal lightweight plastic or metallic shroud 120 cooperates with the lightweight plastic or metallic filter casing 104 and filter casing cap 118 as interior partitions and flow forming conduits to cause recirculation of the power steering fluid uniformly over the interior surface 354 of housing wall 352 to thereby greatly enhance fluid cooling. Housing 108 is made from one solid monolithic metallic thin-walled uncoated heat transfer material throughout, preferably made by casting in one piece, thereby requiring no joint seals to prevent fluid leakage other than gasket 320 for top cover 110. This monolithic structure provides no barriers, such as weld joints or the like to impede heat transfer from the interior fluid to exterior ambient through the thin walls 355,140 and 330 and fins 322 and 350. Preferably housing 108 and cap 110 are made of a cast magnesium alloy such as AZ91D. Preferably pressure die casting processes are employed so that walls 355,140 and 330 as well as fins 332 and 350 may be made as thin as possible. Wall thickness is further reduced due to the use of magnesium alloy, which can be cast thinner than aluminum, thereby further reducing the weight and cost of unit 100 while increasing its heat transfer capability. However, as an alternative material, cast aluminum alloy, such as A383 or ADC12, may be utilized as a substitute for the magnesium. The inlet nipple 360 for hose or pipe connection for return fluid under pressure from the power steering unit PSU, and the outlet nipple 364 for connection to the hose or pipe for gravity or suction return to pump 22, are also integral portions of the casting and add to the heat radiating surface area of the unit. The internal fins 356 of housing 108 improve heat transfer to the housing wall 352, and also function to channel and diffuse the fluid within housing 108 on its return cooling path to outlet nipple 364. The external Gins 350 of housing 108, as well as the cap fins 332, due to the monolithic cast construction, efficiently function to transfer heat from the internal fins 356 and from walls 352 and 330 to the outside ambient both by radiation and by surrounding air movement of the vehicle.

The external configuration of unit 100 as illustrated is generally cylindrical. However the external shape can be adapted to customer requirements and vehicle location, and alternatively may be square, rectangular, round (cylindrical or elliptical) or even of hollow canister shape with interior air passage. The removable combination cap/cover/retainer 110 is also utilized to transfer heat to ambient from the interior of the unit. Cap 112 is conventional and also provides venting to atmosphere in accordance with the usual requirements.

The recirculation shroud 120 may be inexpensively made of any suitable material such as lightweight plastic since it need not be heat conductive. Shroud 120 functions as an internal annular baffle to redirect a portion of the power steering fluid exiting from filter 104 in both an upward and downward circular path and uniformly against the generally cylindrical cooling surface 354 of housing 108, and also causing a portion of the flow to an interior midpoint of the housing 108, thereby increasing the cooling efficiency of the unit.

Unit 100 may be located in the manner of the previously described unit 20 as shown in FIG. 2 or mounted in the manner of the system variations of FIGS. 7, 8 or 9 described previously.

Figure 15:
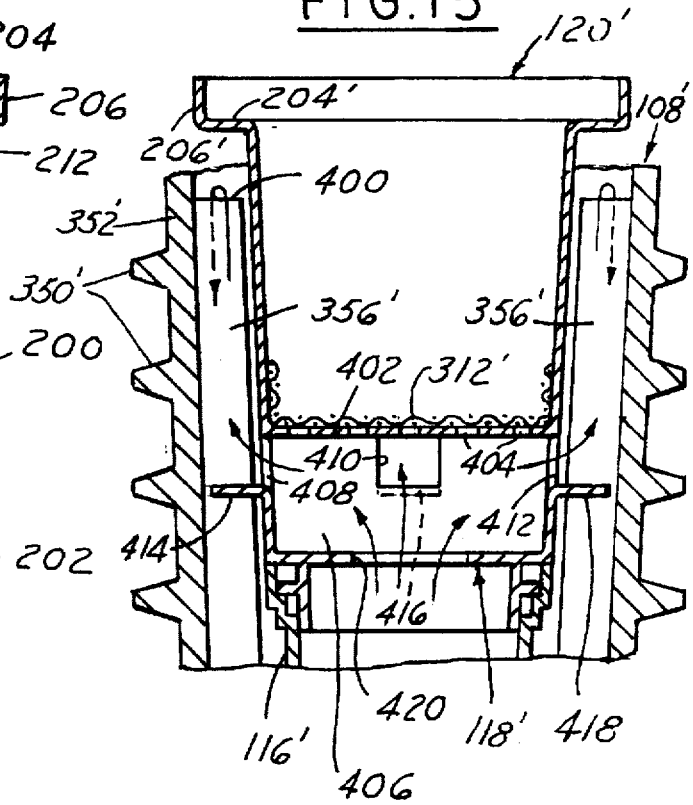
FIG. 15 is a fragmentary vertical center sectional view of second embodiment of a recirculation shroud alternatively provided for use in the unit of FIG. 10.

FIG. 15 illustrates a further modified form of recirculation shroud 120' which may be substituted in place as shroud 120 to recirculate and direct fluid toward the top of the unit. Those elements alike in structure and function as previously described hereinabove are given like reference numerals raised by a prime suffix and their description not repeated.

Shroud 120' is open at its lower end and abuttingly seats on a simplified cap 118' in turn removably seated in the top of filter holder 116'. Housing 108' is also modified by having the internal cooling ribs 356' extend upwardly along the wall 352' so as to each terminate at an upper edge 400 spaced slightly below the housing-installed position of shoulder 204' of shroud 120'. Shroud 120' is provided with a transverse interior partition wall 402 which is perforated by series of small holes 404. A filter screen 312' having a shallow cup-like configuration nests in shroud 120' on top of wall 402. The dependent skirt portion 406 of shroud 420' extending below wall 402 has a circular row of openings such as 408, 410 and 412 spaced angularly apart to provide sufficient outlet openings to register with the channel space between every other pair of adjacent internal ribs 356'. Each of the openings 408,410 and 412 has an associated radially outwardly bent tab 414,416 and 418 respectively which protrudes into the channel space between such alternate pairs of adjacent ribs 356' to thereby facilitate angular registration of the associated skirt openings with the associated rib channel spaces. Cap 118' is provided with a large central outlet opening 420 to communicate the interior of filter 104 with the interior space of skirt 406.

In the operation of the modified shroud 120' and modified housing 108', filtered fluid flows upwardly through opening 420 into the interior space of the shroud 120' below wall 402 and then exits therefrom via openings 408,410 and 412 into the channel space between each adjacent pair of those ribs 356' flanking these openings. The fluid then flows upwardly in the rib channel along the interior surface of wall 352', over the upper edges 400 of such adjacent ribs 356' and then returns downwardly in those channel spaces non-registered with outlets 408–412 and associated tabs 414–418 to the reservoir space between wall 352 and filter holder 116. Tabs 14,416 and 418 thus serve as partitions to channel this fountain-like flow out of shroud 120' upwardly from their associated skirt outlet openings.

Small clearance spaces may be provided between the exterior surface of shroud 120' and the inner edges of ribs 356', and likewise between the tabs 414–418 and respectively adjacent pairs of registered ribs 356', to facilitate manufacture and ease of installation. Such clearances also permit a low volume cross flow of fluid around the tabs and downwardly through the associated tab-registered channel spaces, as well as around the inner edges of ribs 356' to the next adjacent channel spaces. If desired skirt portion 406 may be made as a separate part from the shroud 120' so that partition 402 becomes the bottom wall of a separate cup-like part to also thereby facilitate manufacture. Alternatively, skirt 406 may be formed as an integral portion of cap 118'.

It can thus be seen that there has been provided presently preferred embodiments of a power steering pump fluid/filter system that utilizes a combined cooler, filter and reservoir constructed and arranged to provide maximum cooling; which is positioned to be more directly installed in front of a radiator; which is less costly and adds less weight as contrasted to systems that would use separate coolers and filters.

It is also to be understood that the combination top-fill fluid reservoir, fluid filter and fluid cooler combination unit of the invention is well adapted for use in other vehicle pressurized hydraulic systems in addition to the aforementioned vehicle power steering system, such as for incorporation in the engine oil pressurized lubrication system and/or transmission fluid recirculation system, and the like, in which there is a need for an under-hood accessible fluid reservoir for checking system fluid levels and replenishing the system as well as filtering and cooling of the hydraulic fluid of the system. It will also be understood that the combination unit of the invention is well adapted to systems with fixed or variable fluid flow as well as pressure and suction or gravity flow to and from the fluid pump of the system.

What is claimed is:

1. A combined cooler, top-fill fluid reservoir and filter holder unit with a removable filter for filtering the hydraulic fluid of a vehicle pressurized hydraulic system which includes a pump for producing a pressurized flow of such fluid, comprising:

a body having a peripheral side wall, a bottom base wall and an open upper end, said body walls defining a top-fill fluid reservoir cavity therein, said body being made of heat conductive material, said body including spaced apart integral radial cooling fins on said side wall extending externally about the periphery of said body, said body including spaced inlet and outlet means defining fluid flow openings communicating with said reservoir cavity and adapted for connection respectively to the inlet and outlet of the system pump, cover means removably closing said upper end of said body and being made of heat conductive material, and filter means removably mounted inside said body through said body upper end when opened by removal of said cover means therefrom, said filter means comprising:

a cup-shaped filter cartridge holder having a peripheral side wall generally complemental to said body side wall and spaced inwardly of the interior surface of the body side wall and defining a fluid flow space therebetween, an open upper end, and a bottom base wall having a fluid inlet and being juxtaposed to said body base wall, a holder cover removably mounted on the upper end of said holder, permanent magnet means mounted in said holder adjacent said base wall thereof in fluid flow communication with said body inlet pipe, tubular filter cartridge means disposed in said holder between said magnet means and said holder cover and having a tubular filter element disposed with its exterior surface spaced radially inwardly from the interior surface of said holder for flow of fluid from such surrounding space radially inwardly through the filter element into the interior of the same, shroud means disposed in the cavity reservoir having a lower end juxtaposed to said holder cover and having an open upper end disposed adjacent to the body open upper end, said shroud having a peripheral side wall spaced radially inwardly from the interior surface of said body side wall and defining an annular fluid flow space therebetween, and filter screen means disposed within said shroud in surrounding relation to said cover reservoir fill opening means and operable for screen-filtering fluid supplied to the reservoir cavity through said reservoir fill opening means of said cover.

2. The unit set forth in claim 1 wherein said cover means includes reservoir fill opening means extending therethrough into the reservoir cavity, and a reservoir fill cap for closing said cover fill opening means, said cap and cover having interengaging means for removably holding said cap on said cover.

3. The unit set forth in claim 2 wherein said cover means further includes a dipstick extending downwardly from the underside of said cap into said body reservoir cavity.

4. The unit set forth in claim 1 wherein said side wall of said body is generally tubular.

5. The unit set forth in claim 1 wherein said reservoir cavity has a major axis adapted for vertical orientation in use, wherein said filter means has a tubular geometry and is oriented in the reservoir cavity with its tubular axis generally parallel to the cavity major axis.

6. The unit set forth in claim 1 wherein said body is made of a metal material.

7. The unit set forth in claim 6 wherein said metal material is selected from the group consisting of magnesium and aluminum.

8. The unit set forth in claim 1 wherein said holder, magnet means, filter cartridge means, holder, shroud means and filter screen means components of said filter means are constructed and arranged relative to one another and said body for causing flow of power steering fluid from said body inlet means serially past said magnet means, thence through said filter element to the interior thereof, and thence through said holder means cover out to the annular space defined between the interior surface of the body side wall and the exterior surfaces of said holder and said shroud means for circulation of the filtered fluid adjacent the interior surface of said body wall and thence to said body outlet means.

9. The unit set forth in claim 8 wherein said body inlet means comprises a conduit extending centrally upwardly through said body base wall, and said holder bottom wall fluid inlet includes seal means removably engaging said body inlet conduit.

10. The unit set forth in claim 8 wherein said holder has interior spaced apart rib means for supporting said magnet means for flow of fluid past the periphery thereof via the spaces between said magnet supporting ribs, said magnet means being in the form of an annulus having through-flow opening means for flow of fluid through said annulus.

11. The unit set forth in claim 8 wherein said filter cartridge means includes pressure relief valve means operable to open flow communication between said body inlet means directly to the interior of said filter element in by-pass flow relation to the normal radial flow through the filter element in response to high viscosity cold start pressure and flow conditions of the system fluid for preventing damage to the filter element under such conditions.

12. The unit set forth in claim 1 wherein said holder and said shroud means have cooperative flow directing structure for causing fluid flowing upwardly out of said holder to flow radially outwardly into the fluid flow spaces surrounding said shroud means and said holder.

13. The unit set forth in claim 12 wherein said shroud means comprises a generally tubular member having open top and bottom ends, a first row of flow ports in said side wall thereof adjacent its upper end for flow communication of fluid between the annular space surrounding said shroud side wall and the interior space defined by said shroud side wall, and a second row of flow ports for flow communication of fluid from the shroud wall interior space and the annular space surrounding said shroud means and holder.

14. The unit set forth in claim 12 wherein said body has interior flow directing and cooling ribs for causing said cooperative flow directing structure of said holder and shroud to produce a channeled flow of fluid adjacent the interior surface of said body.

15. The unit set forth in claim 14 wherein said reservoir cavity has a major axis adapted for vertical orientation in use, wherein said filter means has a tubular geometry and is oriented in the reservoir cavity with its tubular axis generally parallel to the cavity major axis, and wherein said flow directing ribs of said body comprise a circumferentially spaced apart row of ribs projecting interiorly from the interior surface of said side wall and extending longitudinally in the direction of the body reservoir cavity major axis to thereby provide flow channels in the annular fluid flow space between the exterior of said holder and the interior surface of said body wall.

16. The unit set forth in claim 15 wherein said shroud means includes a transverse perforated partition spaced above said holder cover and supporting said filter screen means thereabove, said shroud means having skirt means extending below said partition and defining a fluid flow space for receiving filtered fluid exiting from the interior of said tubular filter, said skirt having outlet openings and associated radially outwardly directed tabs individually protruding into associated channel spaces between selected pairs of said internal body ribs and operable for directing fluid upwardly in the associated channel spaces, said ribs terminating at their upper ends below said cover means for communicating fluid flow between all channel spaces defined between said ribs such that fluid flows downwardly into those channel spaces non-registering with said skirt outlet openings and associated tabs to thereby produce an up and down fountain like flow of fluid adjacent the interior surface of said body.

17. The unit set forth in claim 1 wherein said filter screen means, said shroud means, said holder cover, said filter cartridge means and said holder are constructed and arranged as seriatum separable components for sequential removal from said body reservoir cavity in the order recited hereinabove when said body cover means has been removed from said body open upper end, and vice versa.

18. The unit set forth in claim 17 wherein said holder, said shroud means, and said filter screen means are held within said body in a stacked fixed array by said cover means as removably fastened on said body.

19. The unit set forth in claim 1 wherein said reservoir cavity has a major axis adapted for vertical orientation in use, wherein said filter means has a tubular geometry and is oriented in the reservoir cavity with its tubular axis generally parallel to the cavity major axis, and wherein said body side wall has a row of fins projecting interiorly from the interior surface of said side wall and extending parallel to the body reservoir cavity major axis in the annular fluid flow space between the exterior of said holder and the interior surface of said body wall.

20. The unit set forth in claim 1 in combination with a vehicle in which said hydraulic system comprises a power steering system and said pump comprises a power steering pump, an engine compartment located at the front of said vehicle, means for mounting said unit on said vehicle in an accessible location in said engine compartment, and means connecting said body inlet and outlet means of said unit to said inlet and outlet of said power steering pump.

21. The unit set forth in claim 20 wherein said unit is vehicle mounted forwardly of an engine coolant radiator of said vehicle also located in said engine compartment.

22. The unit set forth in claim 21 wherein said unit is vehicle mounted rearwardly of an engine coolant radiator of said vehicle also located in said engine compartment, and including conduit means for directing air from a position forwardly of said radiator to said unit.

23. The unit set forth in claim 22 including system means associated with said conduit means for aspirating air to said unit.

* * * * *